US006563295B2

(12) United States Patent
Juang

(10) Patent No.: US 6,563,295 B2
(45) Date of Patent: May 13, 2003

(54) LOW TEMPERATURE COEFFICIENT REFERENCE CURRENT GENERATOR

(75) Inventor: Dar-Chang Juang, Hsinchu (TW)

(73) Assignee: Sunplus Technology Co., Ltd., Hsinchu (TW)

( * ) Notice: Subject to any disclaimer, the term of this patent is extended or adjusted under 35 U.S.C. 154(b) by 340 days.

(21) Appl. No.: 09/761,683

(22) Filed: Jan. 18, 2001

(65) Prior Publication Data

US 2002/0093324 A1 Jul. 18, 2002

(51) Int. Cl.[7] ..... G05F 3/20

(52) U.S. Cl. ..... 323/315; 327/539

(58) Field of Search ..... 323/313, 315, 323/901, 907; 327/539, 513; 330/288, 297

(56) References Cited

U.S. PATENT DOCUMENTS

RE30,586 E * 4/1981 Brokaw ..... 323/314
4,524,318 A * 6/1985 Burnham et al. ..... 323/313
5,760,639 A * 6/1998 Hall ..... 327/539

* cited by examiner

*Primary Examiner*—Shawn Riley
(74) *Attorney, Agent, or Firm*—Bacon & Thomas, PLLC

(57) ABSTRACT

A low temperature coefficient reference current generator has a bandgap reference voltage generator for providing a low temperature coefficient bandgap reference voltage and a positive temperature coefficient current. The low temperature coefficient reference current generator utilizes the low temperature coefficient bandgap reference voltage to drive a positive temperature coefficient resistor disposed in an IC, so as to produce a negative temperature coefficient current. The positive temperature coefficient current and the negative temperature coefficient current are adjusted and combined to produce a low temperature coefficient reference current.

6 Claims, 2 Drawing Sheets

LOW TEMPERATURE COEFFICIENT REFERENCE CURRENT GENERATOR

BACKGROUND OF THE INVENTION

1. Field of the Invention

The present invention relates to a current reference circuit, and more particularly, to a low temperature coefficient reference current generator.

2. Description of Related Art

In the existing analog circuit design, the analog integrated circuit (IC) usually requires a reference voltage generator and a reference current generator for providing a bias effect, wherein the reference voltage generator can be provided with a low temperature coefficient by using a well-known bandgap technique. However, in order to provide a low temperature coefficient reference current generator, the bandgap reference voltage must be applied to drive a resistor externally connected to the IC. Therefore, the IC must have an additional pin for connecting to the external resistor, which results in a difficulty in miniaturizing the circuit.

To solve such a problem, a direct approach is to fabricate the resistor in the IC. Unfortunately, the resistor that is fabricated by the CMOS (complementary metal oxide semiconductor) IC manufacturing process usually has a relatively large positive temperature coefficient, and thus, the generated current may vary for more than 10% due to the change of the temperature. As a result, the resultant resistor can not meet the requirement of the low temperature coefficient. Therefore, it is desired to have a novel low temperature coefficient reference current generator that is fabricated by standard CMOS IC manufacturing process, while no external resistor is required.

SUMMARY OF THE INVENTION

The object of the present invention is to provide a low temperature coefficient reference current generator, which is almost not influenced by the change of the temperature.

To achieve the object, the low temperature coefficient reference current generator in accordance with the present invention includes a bandgap reference voltage generator, a voltage follower and a current mirror circuit. The bandgap reference voltage generator provides a low temperature coefficient bandgap reference voltage and a positive temperature coefficient current. The voltage follower generates a voltage that follows the low temperature coefficient bandgap reference voltage to drive a positive temperature coefficient resistor, so as to produce a negative temperature coefficient current. The current mirror circuit is provided for proportionally amplifying and combining the positive temperature coefficient current and the negative temperature coefficient current, thereby producing a low temperature coefficient reference current.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
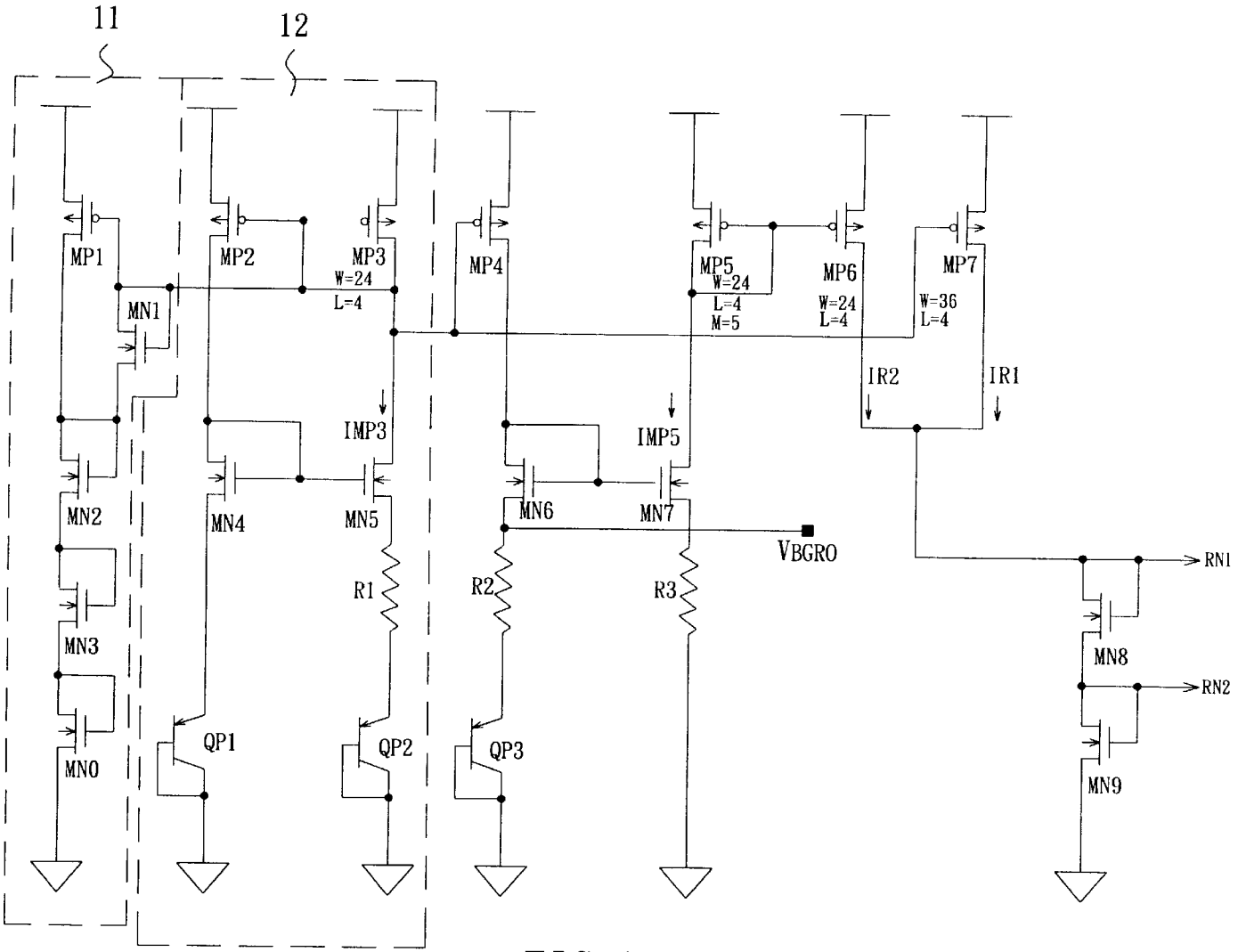
FIG. 1 is the detailed circuit diagram of the low temperature coefficient reference current generator in accordance with the present invention.

FIG. 1 shows a preferred embodiment of the low temperature coefficient reference current generator in accordance with the present invention. As shown, the circuit blocks 11 and 12 are the known startup circuit and power supply independent bias circuit, respectively. The startup circuit 11 is provided to start the circuit so as to prevent the circuit from being locked in a zero voltage position. The bias circuit 12 has a sensing circuit consisting of two BJTs (bipolar junction transistors) QP1 and QP2 for detect the change of temperature. The detected result is a voltage $\Delta V$ on the resistor R1, which has a positive temperature coefficient. Furthermore, because of the effect of the current mirror, we have a constant current $I_{MP3}=\Delta V/R1$, where $\Delta V=V_T\ln(N)$, $I_C=I_S(\exp(V_{BE}/V_T)-1)$, N being the ratio of the number of QP2 over QP1, or the ratio of the emitter area of QP2 over QP1, $V_T=KT/q$, K being the Boltzmann constant, q being the electron charge, T being the absolute temperature, $V_{BE}$ being the voltage drop from the base to emitter, $I_C$ being the collector current, $I_S$ being the saturation leakage current. Therefore, the current $I_{MP3}$ is approximately direct proportional to the absolute temperature.

Because the voltage $V_{BE}$ of the BJT has a negative temperature coefficient, a low temperature coefficient voltage generator can be obtained by combining the detected voltage $\Delta V$, which has a positive temperature coefficient, and the voltage $V_{BE3}$ of the transistor QP3, which has a negative temperature coefficient, where each of the detected voltage $\Delta V$ and the $V_{BE3}$ of the transistor QP3 may be proportional amplified. In this preferred embodiment, the voltage $\Delta V$ is amplified by the current mirror consisting of transistors MP4 and MP3, and the ratio of R2/R1. These two amplified voltage and $V_{BE3}$ are added together to have a low temperature coefficient bandgap reference voltage $V_{BGRO}$.

Figure 2:
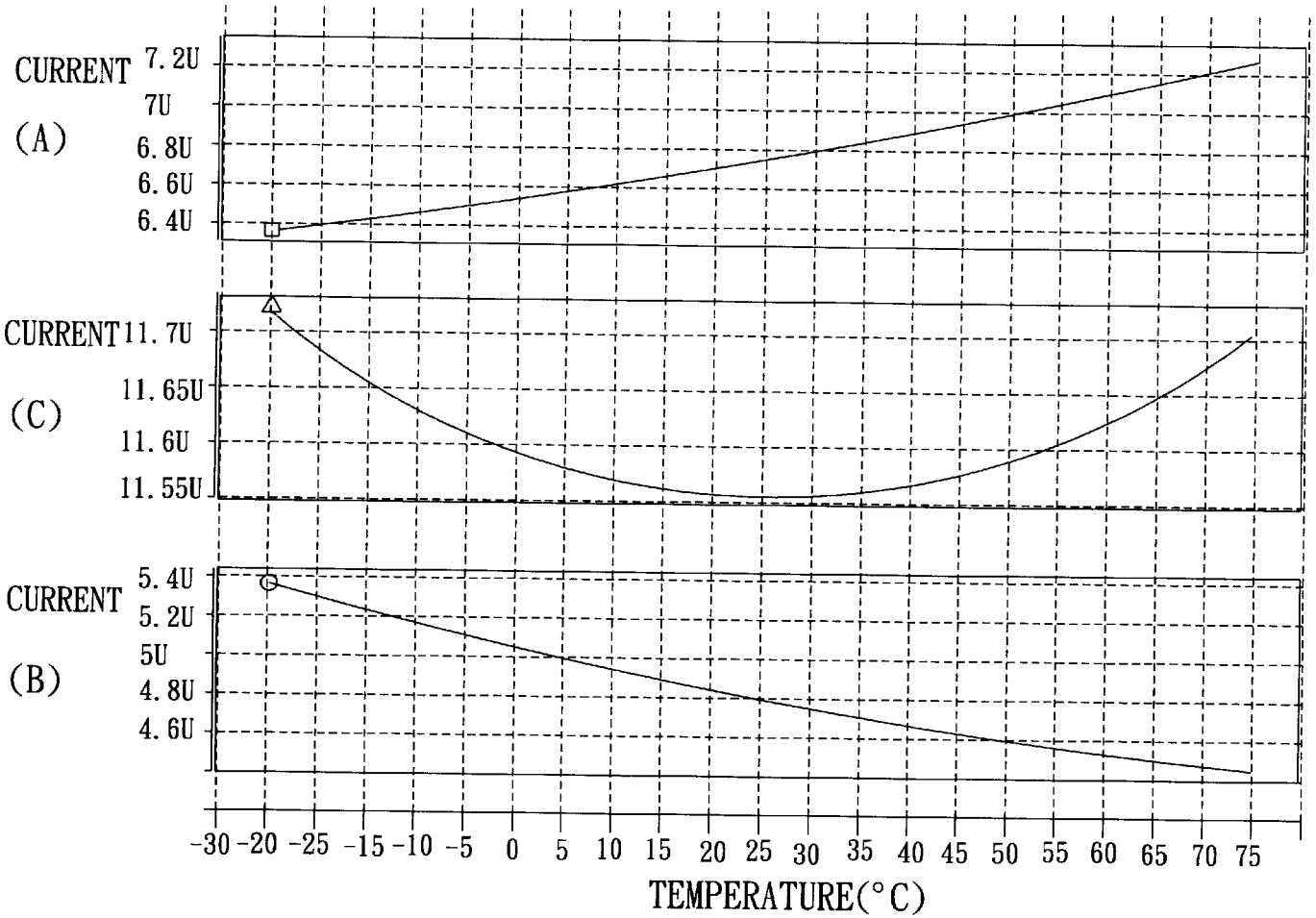
FIG. 2 illustrates the waveforms of the currents generated by the low temperature coefficient reference current generator in accordance with the present invention.

In order to have a low temperature coefficient reference current generator, the above-described voltage generator circuit for providing the low temperature coefficient bandgap reference voltage can be utilized. Because the temperature coefficient of the voltage $V_T$ of a BJT transistor is larger than that of a positive temperature coefficient resistor, the current $I_{MP3}$, that is produced on the circuit path of a positive temperature coefficient sensing circuit formed by the MOS transistor MN5, resistor R1 and BJT transistor QP2, is provided with a positive temperature coefficient. With reference to FIG. 2, the characteristic of the $I_{MP3}$ is represented by the curve (A), which has a variation of 0~+14.1% over the temperature range of −25° C.~+75° C.

Furthermore, the circuit is provided with a voltage follower consisting of two MOS transistors MN6 and MN7, each having a gate connected to the gate of the other one. The low temperature coefficient bandgap reference voltage $V_{BGRO}$ is applied to the voltage follower to generate a followed voltage for driving a positive temperature coefficient resistor R3 that is disposed inside an IC. Such a positive temperature coefficient resistor may be a P+, N+, poly-, or well- resistor. Due to the positive temperature coefficient of the resistor R3, a negative temperature coefficient current $I_{MP5}$ is produced. With reference to FIG. 2, the characteristic of the $I_{MP5}$ is represented by the curve (B), which has a variation of 0~20%. over the temperature range of −25° C.~+75° C.

The positive temperature coefficient current $I_{MP3}$ is amplified by a current mirror consisting of MOS transistors MP7 and MP3, so as to obtain a positive temperature coefficient current $I_{R1}$. The negative temperature coefficient current $I_{MP5}$ is amplified by a current mirror consisting of MOS transistors MP6 and MP5, so as to obtain a negative temperature coefficient current $I_{R2}$. Herein, the amplification ratio is determined by the width to length ratio (W/L) and the number (M) of the MOS transistor. In this preferred embodiment, we have $I_{R1}=((36/4)/(24/4))^* I_{MP3}=1.5 {}^*I_{MP3}$ and $I_{R2}=(24/4)/((24/4)^*5)^* I_{MP5}=0.2^* I_{MP5}$. Therefore, by proportionally amplifying and combining the two currents $I_{MP3}$ and $I_{MP5}$, a desired low temperature coefficient current source $I_{OUT}$ is obtained, where $I_{OUT}=I_{R1}+I_{R2}=K^*I_{MP5}+L^* I_{MP3}$, K and L being ratio constant. With reference to FIG. 2, the characteristic of the current $I_{OUT}$ is represented by the curve (C), which only has a variation of 0~1.4% over the temperature range of −25° C. −75° C. Accordingly, a low temperature coefficient reference current generator that is almost not influenced by the change of the temperature is achieved.

Although the present invention has been explained in relation to its preferred embodiment, it is to be understood that many other possible modifications and variations can be made without departing from the spirit and scope of the invention as hereinafter claimed.

What is claimed is:

1. A low temperature coefficient reference current generator comprising:

a bandgap reference voltage generator for providing a low temperature coefficient bandgap reference voltage and a positive temperature coefficient current;

a voltage follower for generating a voltage that follows the low temperature coefficient bandgap reference voltage to drive a positive temperature coefficient resistor, so as to produce a negative temperature coefficient current; and a current mirror circuit for proportionally amplifying and combining the positive temperature coefficient current and the negative temperature coefficient current, thereby producing a low temperature coefficient reference current.

2. The low temperature coefficient reference current generator as claimed in claim 1, wherein the voltage follower consists of two MOS transistors, each having a gate connected to the gate of the other one.

3. The low temperature coefficient reference current generator as claimed in claim 1, wherein the positive temperature coefficient resistor is disposed inside an IC.

4. The low temperature coefficient reference current generator as claimed in claim 1, wherein the current mirror circuit comprising:

a first current mirror for proportionally amplifying the positive temperature coefficient current; and a second current mirror for proportionally amplifying the negative temperature coefficient current.

5. The low temperature coefficient reference current generator as claimed in claim 4, wherein the first current mirror consists of two MOS transistors.

6. The low temperature coefficient reference current generator as claimed in claim 4, wherein the second current mirror consists of two MOS transistors.

* * * * *